US006029594A

United States Patent [19]

Gottlieb

[11] Patent Number: 6,029,594

[45] Date of Patent: Feb. 29, 2000

[54] SAILBOARD UTILIZING A DUAL-HOOK/ LOOP CONNECTOR

[75] Inventor: Steve B. Gottlieb, South Daytona, Fla.

[73] Assignee: AeroTech Sails, Inc., South Daytona, Fla.

[21] Appl. No.: 09/222,424

[22] Filed: Dec. 29, 1998

[51] Int. Cl.[7] ..... B63H 9/04

[52] U.S. Cl. ..... 114/108; 114/102.12

[58] Field of Search ..... 114/39.12, 39.16, 114/39.29, 102.1, 102.11, 102.12, 102.18, 102.19, 102.2, 102.21, 104, 108, 114, 115

[56] References Cited

U.S. PATENT DOCUMENTS

| | | | |
|---|---|---|---|
| 3,129,685 | 4/1964 | Kanser | 114/108 |
| 5,134,952 | 8/1992 | Doolittle | 114/39.12 |
| 5,189,976 | 3/1993 | Cochran et al. | 114/102 |
| 5,195,444 | 3/1993 | Daniels | 114/39.2 |
| 5,904,112 | 5/1999 | Tylaska et al. | 114/108 |

*Primary Examiner*—Jesus D. Sotelo

*Attorney, Agent, or Firm*—James H. Beusse; Holland & Knight LLP

[57] ABSTRACT

A sailboard utilizing a dual-hook/loop connector is provided for attaching a sail 35 to a sailboard. The sailboard includes a hull, a base unit attached to the hull, a boom attached to the base unit, a sail 35 having a first side 40 and a second side 45 opposed the first side 40, with an edge 50 therebetween, and further having at least a first means for receiving 55 attached to the first side 40 and a second means for receiving 60 attached to the second side 45 opposed the first means for receiving 55, and a device for attaching the sail 35 to the hull, base unit, or boom including at least a first hook 115 and a second hook 120 opposed the first hook 115, where the first hook 115 and the second hook 120 are operable to engage the first means for receiving 55 and the second means for receiving 60, respectively, and further including a mechanism operable to engage a line from the hull, base unit, or boom.

16 Claims, 1 Drawing Sheet

SAILBOARD UTILIZING A DUAL-HOOK/ LOOP CONNECTOR

FIELD OF THE INVENTION

The field of this invention relates to windsurfing boards or sailboards, and more specifically, to an improved connector utilizing a dual-hook/loop for attaching a sail to a sailboard.

BACKGROUND OF THE INVENTION

A windsurfing board or sailboard is known in the prior art, as disclosed in U.S. Pat. No. 5,195,444 to Daniels, incorporated herein by reference.

The prior art apparatus for connecting a sail to a sailboard includes a single hook that is inserted into a metal grommet in the sail. The use of a single hook caused a significant amount of stress in the sail, as the force was applied at a single point and over a small surface area. This required that the sail be reinforced to prevent damage from ripping or tearing. In addition, the use of a single hook makes it difficult to attach and remove the hook from the sail, partly because line from the sailboard often had to be re-threaded during rigging and de-rigging.

Accordingly, it is an object of this invention to provide a connector for connecting a sail to a sailboard which reduces the stress in the sail and which is easy to attach and remove.

SUMMARY OF THE INVENTION

In order to achieve these and other objects of the invention, a sailboard is provided having a hull, a base unit attached to the hull, a boom attached to the base unit, a sail having a first side and a second side opposed the first side, with an edge therebetween, and further having at least a first means for receiving attached to the first side and a second means for receiving attached to the second side opposed the first means for receiving, and a device for attaching the sail to the hull, base unit, or boom having at least a first hook and a second hook opposed the first hook, where the first hook and the second hook are operable to engage the first means for receiving and the second means for receiving, respectively, and further including a mechanism operable to engage a line from the hull, base unit, or boom. In one embodiment of the present invention, the first hook and the second hook are spaced apart so that an opening exists therebetween, wherein the opening is operable to receive the edge of the sail therein. The first and second means for receiving may consist of a first and second loop, respectively.

The double hook and loop reduces the tension applied to the sail. First, there are two points of pressure instead of one. Second, a significant portion of each loop is attached to the sail, thereby increasing the surface area over which the tension may be spread. This tension reduction allows the sail to be manufactured more efficiently and less costly as less reinforcement of the sail is required. Also, this configuration allows the sail to be easily attached to and removed from the sailboard.

DETAILED DESCRIPTION OF THE INVENTION

Figure 1:
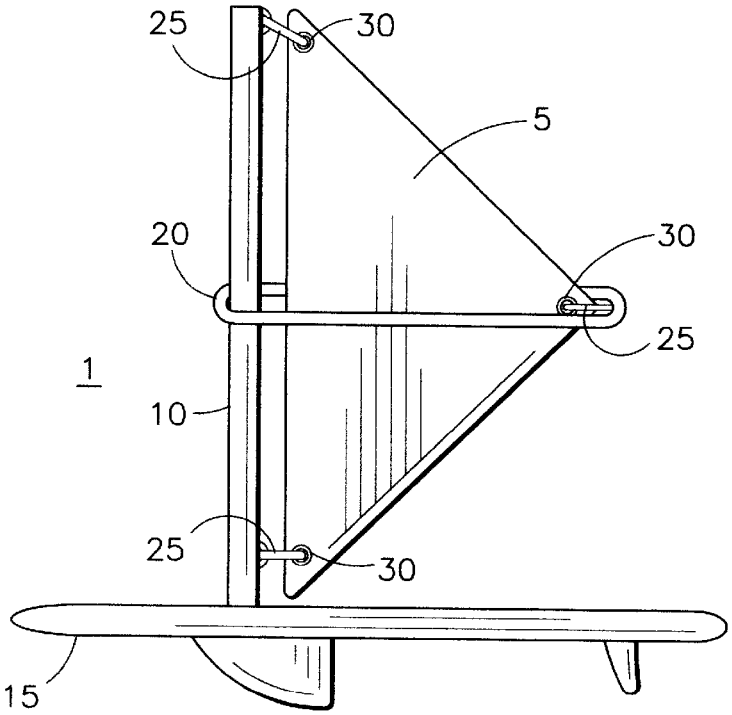
FIG. 1 PRIOR ART
FIG. 1 is a side view of a sailboard as disclosed in the prior art.

Referring to FIG. 1, which depicts a sailboard 1 as disclosed in the prior art, a sailboard 1 comprises a sail 5 which is attached to a base unit 10, which in turn is attached to a hull 15. A boom 20 extends horizontally and perpendicular to the base unit 10, and encircles the base unit 10 and the sail 5. The boom 20 is attached to the base unit 10 at one end, and to the sail 5 at the other end.

A device 25 is used to connect the sail 5 to the base unit 10, and may also be used to connect the sail 5 to the boom 20 or the hull 15. The sail 5 includes means for receiving 30 capable of mating with the device 25. The device 25 may typically be a line or single hook. The means for receiving 30 may typically be a circular grommet capable of receiving a line or a single hook.

The present invention discloses a connector for attaching the sail 5 to the hull 15, base unit 10, or boom 20 of the sailboard 1 that replaces the device 25 and the means for receiving 30 of the prior art. This connector utilizes a dual hook/loop.

Figure 2:
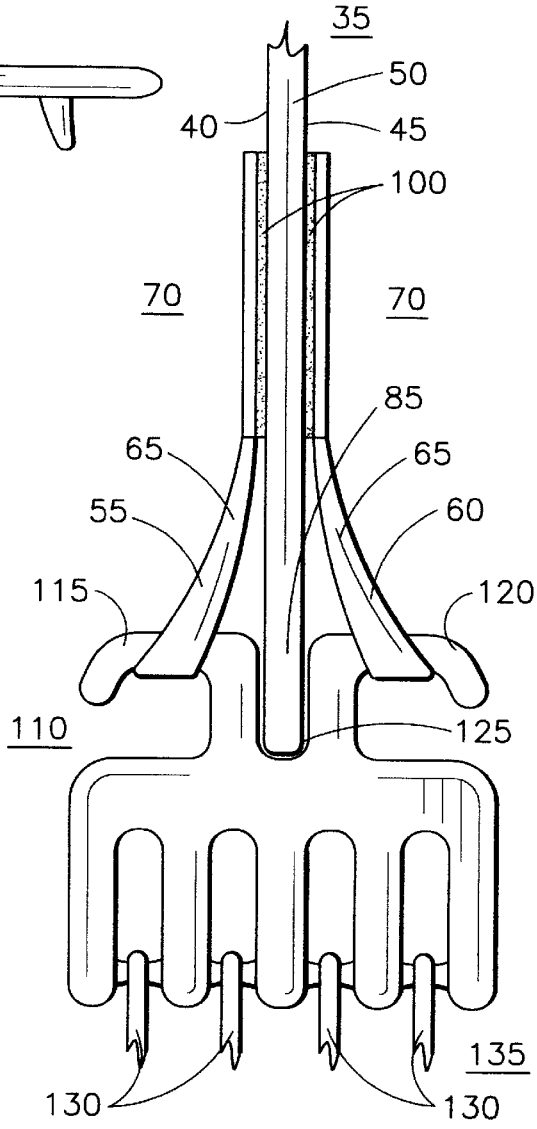
FIG. 2 is a front view of the dual-hook/loop connector and sail as disclosed in one embodiment of the present invention.
Figure 3:
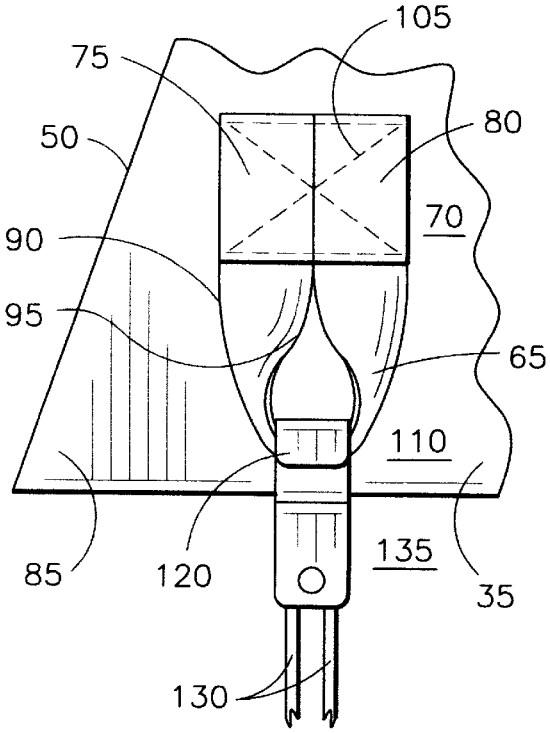
FIG. 3 is a side view of the dual-hook/loop connector and sail of FIG. 2.

Referring now to FIG. 2 and 3, where like structures are numbered consistently, a sail 35 having a first side 40 and a second side 45 opposed the first side 40, with an edge 50 therebetween, includes at least a first means for receiving 55 attached to the first side 40 and a second means for receiving 60 attached to the second side 45 opposed the first means for receiving 55. The first means for receiving 55 and the second means for receiving 60 do not require that a hole be punched in the sail 35 as disclosed in the prior art.

In one embodiment of the present invention, the first means for receiving 55 and the second means for receiving 60 each comprise an unattached middle portion 65 of a strip 70 of material having a first end 75 and a second end 80 that may be attached to the sail 35. The first means for receiving 55 and the second means for receiving 60 may be located proximate the edge 50 of the sail 35, preferably proximate a corner 85 of the sail 35.

The first end 75 and the second end 80 of the strip 70 may be placed adjacent one another so that the middle portion 65 forms a loop vertically between them, or they may be placed apart so that the middle portion 65 forms a loop horizontally between them. A first edge 90 of the middle portion 65 and a second edge 95 of the middle portion 65 may be folded and attached together using an adhesive or a thread so that the middle portion 65 may be more easily inserted within a hook.

Each strip 70 of material may have a rectangular shape, with a length of about six inches and a width of about one inch. The first end 75, the middle portion 65, and the second end 80 may each have substantially the same surface area of about two square inches. Each strip 70 may be constructed using a durable material such as a nylon mesh, and the first end 75 and the second end 80 may be attached to the sail 35 using an adhesive 100 or a thread 105.

In another embodiment of the present invention, the first means for receiving 55 and the second means for receiving 60 may each be made from a strip that is attached to the sail 35 at one end, with the other end containing an eyelet or grommet capable of receiving a hook.

The connector includes a device 110 for attaching the sail 35 to the hull 15, base unit 10, or boom 20 comprising at least a first hook 115 and a second hook 120 opposed the first hook 115, where the first hook 115 and the second hook 120 are operable to engage the first means for receiving 55 and the second means for receiving 60 on the sail 35, respectively. The first hook 115 and the second hook 120 may be slightly downward-sloping so as to make them more reliable retaining mechanisms. The first hook 115 and the second hook 120 may be composed of a metal or a hard plastic.

In one embodiment of the present invention, the first hook 115 and the second hook 120 are oppositely-facing and spaced apart so that an opening 125 exists therebetween that is operable to receive the edge 50 of the sail 35 therein. Opening 125 may be, for example, about five millimeters. The edge 50 of the sail 35 that is proximate the first means for receiving 55 and the second means for receiving 60 may be inserted into the opening 125, and the first hook 115 and the second hook 120 may be used to securely engage the first means for receiving 55 and the second means for receiving 60, respectively.

The connector is able to spread the force applied to the sail 35 over a total surface area of eight square inches (four square inches on each side of the sail 35). In addition, the connector is very reliable, as it is able to transfer force in any direction by means of the interaction of the first means for receiving 55, the second means for receiving 60, the first hook 115, and the second hook 120, and the interaction of the edge 50 of the sail 35 and the device 110.

The device 110 also includes a mechanism capable of securely engaging a line 130 from the hull 15, base unit 10, or boom 20. In one embodiment of the present invention, this mechanism is a pulley 135, which is well-known in the sailboard industry. The pulley 135 consists of a plurality of prongs with rollers between them. The line 130 may be threaded across the rollers, which allow the line 130 to move freely as it is taken up or released.

I claim:

1. A sailboard comprising:

a hull;

a base unit attached to said hull;

a boom attached to said base unit;

a sail having a first side and a second side opposed said first side, with an edge therebetween, and further comprising at least a first means for receiving attached to said first side and a second means for receiving attached to said second side opposed said first means for receiving; and a device for attaching the sail to the hull, base unit, or boom comprising at least a first hook and a second hook opposed said first hook, said first hook and said second hook being operable to engage said first means for receiving and said second means for receiving, respectively, and further comprising a mechanism operable to engage a line from the hull, base unit, or boom.

2. The sailboard of claim 1 wherein said first hook and said second hook are spaced apart so that an opening exists therebetween, said opening operable to receive the edge of the sail therein.

3. The sailboard of claim 2 wherein said first hook and said second hook are oppositely-facing.

4. The sailboard of claim 1 wherein said first means for receiving and said second means for receiving each comprise an unattached middle portion of a strip of material having a first end and a second end that are attached to the sail.

5. The sailboard of claim 4 wherein said first end and said second end are placed adjacent one another so that the middle portion forms a loop vertically therebetween.

6. The sailboard of claim 4 wherein the strip of material comprises a nylon mesh.

7. The sailboard of claim 4 wherein the strip of material has a rectangular shape.

8. The sailboard of claim 7 wherein the strip of material has a length of about six inches and a width of about one inch.

9. The sailboard of claim 4 wherein said first end, said middle portion, and said second end each have substantially the same surface area.

10. The sailboard of claim 4 wherein a first edge of the middle portion and a second edge of the middle portion are folded and attached together.

11. The sailboard of claim 4 wherein each strip of material is attached to the sail using an adhesive or a thread.

12. The sailboard of claim 1 wherein the first means for receiving and the second means for receiving are located proximate the edge of the sail.

13. The sailboard of claim 1 wherein the first means for receiving and the second means for receiving are located proximate a corner of the sail.

14. A sailboard connector for attaching a sail to a base unit comprising at least a first hook and a second hook opposed said first hook, said first hook and said second hook being operable to engage a first means for receiving attached to a first side of the sail and a second means for receiving attached to a second side of the sail opposed said first means for receiving, respectively, and further comprising a mechanism operable to engage a line from the base unit.

15. The sailboard connector of claim 14 wherein said first hook and said second hook are spaced apart so that an opening exists therebetween, said opening operable to receive the edge of the sail therein.

16. The sailboard connector of claim 15 wherein said first hook and said second hook are oppositely-facing.

* * * * *